United States Patent [19]

Yagishita et al.

[11] Patent Number: 4,746,441

[45] Date of Patent: May 24, 1988

[54] METHOD OF PURIFYING BRINE FOR ELECTROLYTIC CHEMICAL PRODUCTION

[75] Inventors: Aisaburo Yagishita, Nagoya; Fumio Hine, Kasugai, both of Japan

[73] Assignee: Kabushiki Kaisha Sanshin Seisakusho, Aichi, Japan

[21] Appl. No.: 831,807

[22] Filed: Feb. 21, 1986

[51] Int. Cl.[4] ..... C02F 1/58

[52] U.S. Cl. ..... 210/712; 210/779; 210/798; 210/805

[58] Field of Search ..... 210/712, 713, 779, 797, 210/798, 805, 665

[56] References Cited

U.S. PATENT DOCUMENTS

| | | | |
|---|---|---|---|
| 3,577,341 | 5/1971 | Keith, Jr. et al. | 210/798 X |
| 3,929,639 | 12/1975 | Turner et al. | 210/805 X |
| 4,028,241 | 6/1977 | Davis et al. | 210/712 |
| 4,157,962 | 6/1979 | Huang et al. | 210/798 |
| 4,340,487 | 7/1982 | Lyon | 210/797 X |
| 4,343,621 | 8/1982 | Benninger et al. | 210/779 X |

*Primary Examiner*—Tom Wyse

*Attorney, Agent, or Firm*—Shlesinger, Arkwright & Garvey

[57] ABSTRACT

The brine purifying system employs a multistage filtering apparatus comprising a plurality of the same filter units piled up one over another to form a plurality of cascaded filtering stages. When the filter layers of the filter units are clogged with unsoluble matters, the operation of the multistage filtering apparatus is interrupted, then a solvent for the unsoluble matters is circulated through the multistage filtering apparatus to remove the unsoluble matters arrested by the filter layers by dissolving the same therein. Then, a washing liquid is circulated through the multistage filtering apparatus to wash the multistage filtering apparatus completely. The solvent and the washing liquid used for regenerating and washing the multistage filtering apparatus are recovered and are used for dissolving salt to prepare saturated brine. The unsoluble matters thus removed from the filter layers are removed by being precipitated in a precipitating tank.

2 Claims, 3 Drawing Sheets

METHOD OF PURIFYING BRINE FOR ELECTROLYTIC CHEMICAL PRODUCTION

BACKGROUND OF THE INVENTION

The present invention relates to a method of purifying brine to be subjected to electrolyzation for producing caustic soda and chlorine, and a system for carrying out the same.

In electrolyzing salt, it is usual practice to supply brine prepared by dissolving salt in water and purified by removing impurities contained in the salt solution, to an electrolyzer. Recently, the electrolytic process for electrolyzing brine has been converted progressively from the membrane system into the ion exchange membrane system with the increase in demand for electrolytic caustic soda of higher purity; consequently, the purification of brine has become regarded as important.

When brine containing much hardness components is supplied to the electrolytic process of the ion exchange membrane system, the performance of the ion exchange membranes is deteriorated and the life of the same is remarkably reduced. Accordingly, the brine needs to be treated through filtering layers packed with a chelate resin, for high purification before the brine is supplied to an electrolyzer.

FIG. 1 illustrates a conventional brine purifying system. Referring to FIG. 1, dechlorinated dilute brine recovered from an electrolyzer 14 is returned from a dechlorinated dilute brine tank 13 to a saturated brine tank 1. The saturated brine tank 1 is replenished with salt and, if necessary, water to prepare saturated brine. The saturated brine is supplied to a mixing tank 2, where caustic soda or sodium carbonate is mixed in the saturated brine to produce so-called brine mud. The saturated brine containing the brine mud is supplied to a thickener 3, where the most part of the brine mud is deposited and the deposited brine mud is discharged outside the system from the bottom of the thickner 3.

Since the supernatant saturated brine supplied from the thickner 3 usually contains a minute amount of unsoluble solid matters, the supernatant saturated brine is stored temporarily in a supernatant saturated brine tank 4, and then the supernatant saturated brine is supplied to a filtering apparatus 6. The filtered and purified brine is stored in a purified brine tank 7, and then the purified brine is supplied to a chelate resin tower 8, where a small amount of the residual impurity ions are removed. Then, hydrochloric acid is added to the purified brine in a pH adjusting tank 9 to adjust the pH of the purified brine. Then, this high purity brine is supplied to the electrolyzer.

However, it was found that the life of the chelate resin is greatly dependent on the amount of suspended solid matters remaining in the brine and that a high degree of separation of the solid matters is necessary in addition to solid matter separation by means of the thickener. In order to meet such a requirement, purified brine obtained by separating the solid matters from the saturated brine by means of the thickner. In order to achieve the satisfactory filtration of the supernatant brine through the perfect separation of the solid matters, the brine feed rate needs to be reduced and the filtering apparatus needs to be washed frequently for regeneration, which causes an increase in the brine purifying cost.

SUMMARY OF THE INVENTION

Accordingly, it is an object of the present invention to provide a method of purifying brine and a brine purifying system for carrying out the same which are capable of fine purification of brine at a low cost.

The present invention improves the conventional brine purifying system for producing highpurity brine suitable for electrolyzation of the ion exchange mebrane system, in which dilute brine recovered from the brine electrolyzer is saturated with salt again, then the saturated brine is alkalified to separate solid matters therefrom, then the alkalified brine is passed through a fine filtering process, and then the filtered brine is passed through the layers of a chelate resin.

A brine purifying system of the present invention includes a filtering apparatus equipped with fixed filtering layers. When the filtering efficiency of the filtering apparatus is reduced due to the accumulation of unsoluble matters in the fixed filtering layers, the supply of the supernatant brine to the filtering apparatus is interrupted, then a solvent for the unsoluble matters, containing hydrochloric acid is supplied to the filtering apparatus and, if necessary, the solvent is circulated through the filtering apparatus to remove the unsoluble matters from the fixed filtering layers by dissolving the unsoluble matters, then the filtering apparatus is washed by filtered and purified brine or pure water, and then the supernatant brine is supplied to the filtering apparatus to continue the filtering operation. All or part of the solvent, and the washing water or the washing brine are recovered and is used for preparing the saturated brine.

Conventional brine purifying system requires considerable work and labor for separating the mud arrested by the filtering apparatus by backwashing the filtering apparatus, for separating the mud from the washing water and for throwing away the separated mud. According to the present invention, since the most part of the mud is dissolved in the solvent and is returned to the salt dissolving tank, the work for washing the filtering apparatus and the inoperative time required for washing the filtering apparatus are reduced remarkably.

Furthermore, the filtering apparatus employed in the brine purifying system of the present invention is equipped with fixed filtering layers which need not be coated with a filtering agent; therefore, the operation of the filtering apparatus can be started immediately after the completion of washing, and hence the operation rate of the brine purifying system is enhanced, which further enhances the efficiency of the brine purifying system.

Furthermore, according to the present invention, the solvent and the washing water used for washing the filtering apparatus are recovered and are used for dissolving salt, which has never been tried in the conventional brine purifying system, and hence little washing water is discharged outside the system and all the washing water used for washing the filtering apparatus is utilized effectively as process water. On the other hand, although the solid matters removed from the filtering apparatus is returned to the salt dissolving tank, the solid matters are precipitated by alkalifying the primary brine and the precipitated solid matters are deposited in a thickener. Therefore, the removed solid matters never accumulate in the system and never affect the operation of the brine electrolyzer adversely.

The above and other objects, features and advantages of the present invention will become more apparent from the following description of the preferred embodiments thereof taken in conjunction with the accompanying drawings.

DESCRIPTION OF THE PREFERRED EMBODIMENT

Figure 1:
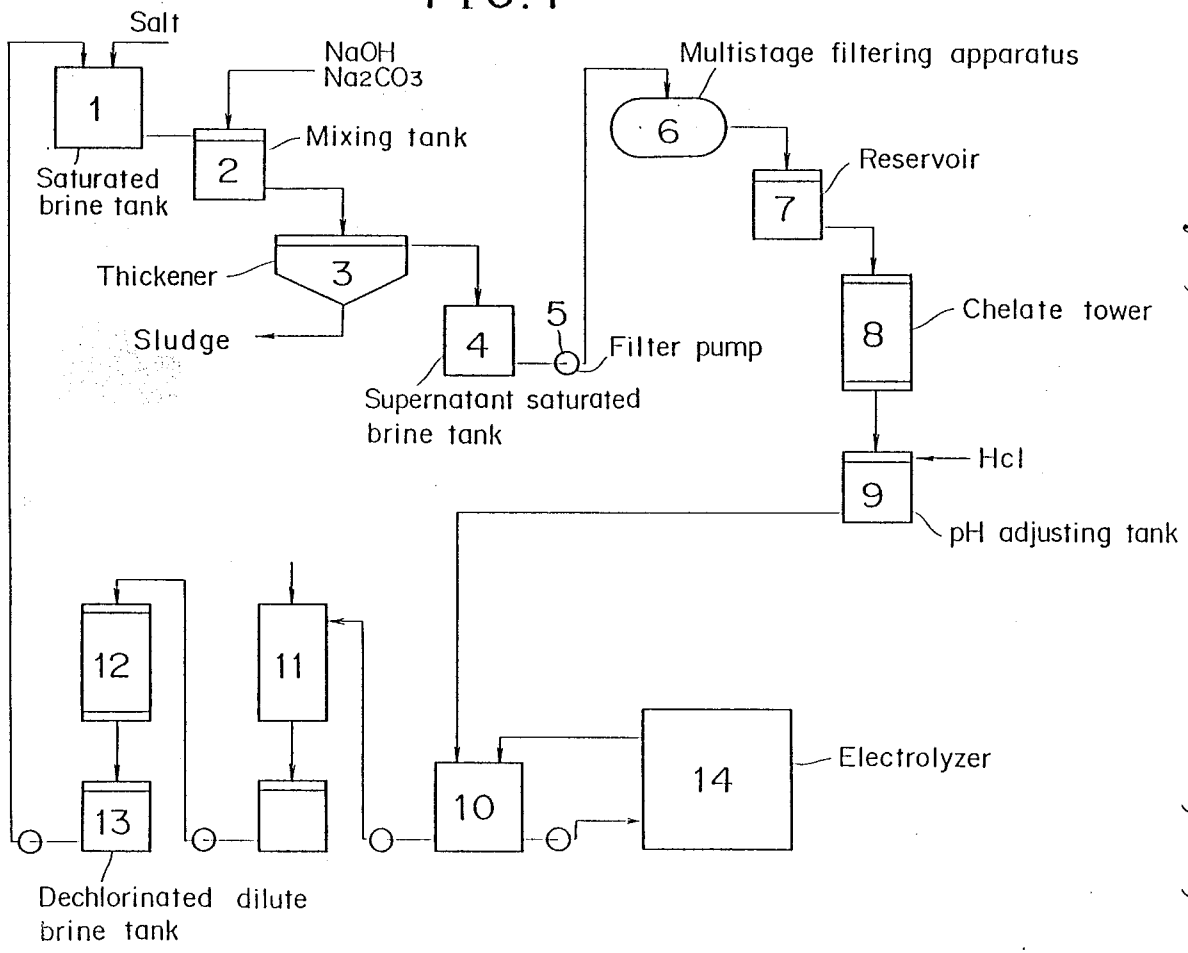
FIG. 1 is a block diagram of a conventional brine purifying system.
Figure 2:
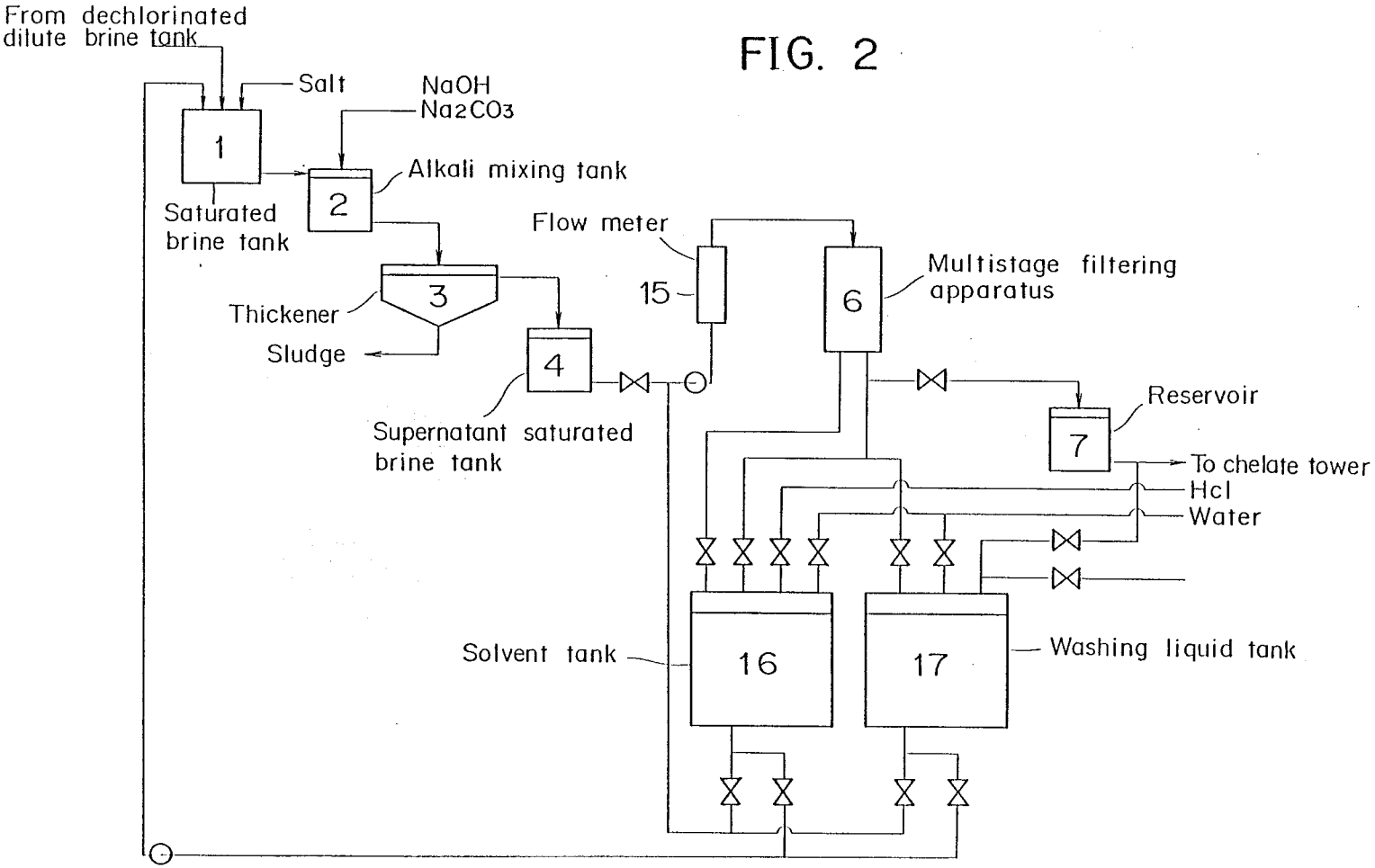
FIG. 2 is a block diagram of a brine purifying system, in a preferred embodiment, according to the present invention.

A brine purifying system of the present invention illustrated in FIG. 2, except the multistage filtering apparatus and the associated apparatus thereof, is practically the same as the conventional brine purifying system illustrated in FIG. 1. In FIGS. 1 to 4, like reference characters designate like or corresponding parts throughout.

Referring to FIG. 2, saturated brine prepared in a saturated brine tank 1 is supplied through an alkali mixing tank 2 and a thickener 3 to a supernatant brine tank 4. Supernatant brine is supplied by means of a filter pump 5 through a flow meter 15 to a multistage filtering apparatus 6 having fixed filter layers 70. The supernatant brine is filtered and purified by the filtering apparatus and the purified brine is stored temporarily in a reservoir 7. And then the purified brine is supplied to a chelate tower 8.

The supernatant brine contains minute flocks of unsoluble matters consisting mainly of magnesium hydroxide, iron hydroxide, potassium carbonate and a small amount of clay and minerals. Normally, the concentration of the unsoluble matters in the supernatant brine is about 10 mg/l. The accumulation of the unsoluble matters in the fixed filter layers increases the filtering resistance of the fixed filter layers and require increase in filtering pressure. Since the excessive increase of the filtering pressure above an upper limit causes the unsoluble matters to permeate the fixed filtering layers, the operation of the multistage filtering apparatus must be stopped and the multistage filtering apparatus must be washed before the filtering pressure reaches the upper limit.

Figure 4:
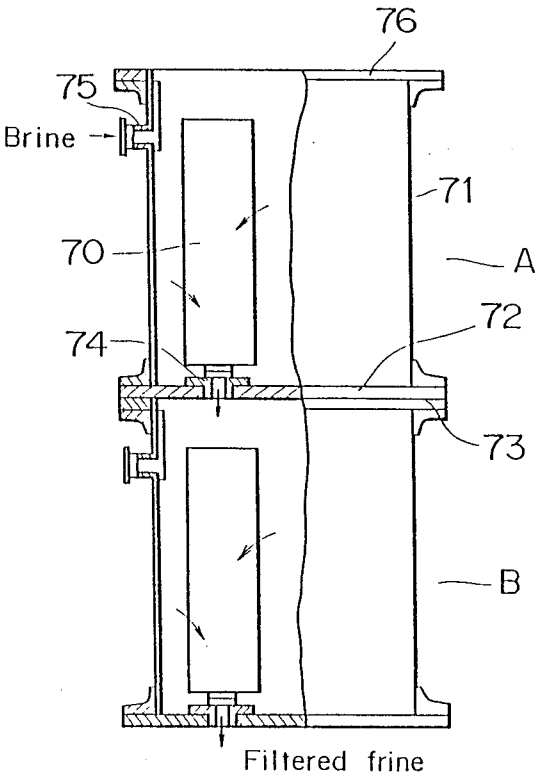
FIG. 4 is a partially cutaway side elevation of the multistage filtering apparatus of FIG. 3.
Figure 3:
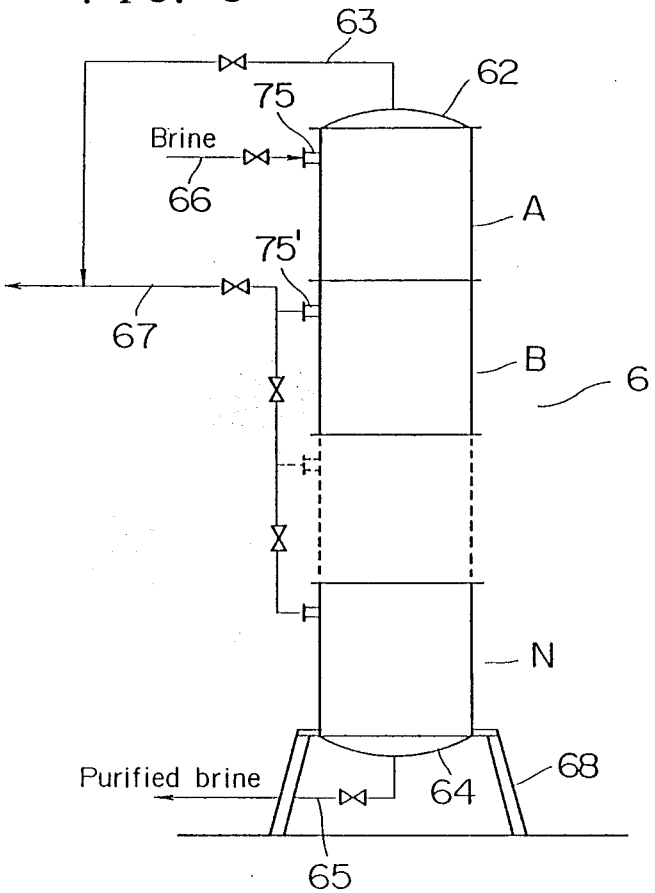
FIG. 3 is a conceptional illustration of a multi-stage filtering apparatus employed in the brine purifying system of FIG. 2.

The multistage filtering apparatus 6 and the peripheral apparatus will be described hereinafter with reference to FIGS. 3 and 4.

The multistage filtering apparatus 6 integrally comprises a plurality of filter units A, B, . . . and N placed one over another, a top cover 62 and a bottom cover 64. An air pipe 63 is provided on the top cover 62 to increase or to reduce the internal pressure of the multistage filtering apparatus 6. A purified brine discharge pipe 65 is provided on the bottom cover 64. Each filter unit comprises a body 71 and a filter layer 70 provided within the body 71. A pipe 75 is attached to the side wall of the body 71; the pipe 75 serves as both an air vent pipe and a liquid inlet pipe. A brine outlet 74 is formed in the bottom plate 72 of each filter unit and the filter layer 70 of the cartridge type is attached to the brine outlet 74 so that the brine supplied into the filter unit passes through the filter layer 70 and flows into the next filter unit through the brine outlet 74.

The periphery of the flat bottom plate 72 forms a lower flange 74, while an upper flange 76 is formed around the upper periphery of the body 71. A gasket is placed between the respective flanges of the adjacent filter units and the flanges are fastened together with bolts and nuts to join the adjacent filter units.

The multistage filtering apparatus 6 is mounted on a frame 68 and a brine supply pipe 66 and an air pipe 67 are connected to the multistage filtering apparatus 6. Standadized branch pipes are used for connecting the brine supply pipe 66 and the air pipe 67 to the filter units A, B . . . and N, and hence the number of the filter units can be changed simply by adding or removing a necessary number of filter units and connecting or disconnecting the filter units by the standardized branch pipes.

In starting the operation of the multistage filtering apparatus 6, first the air vent valves of the filter units A, B, . . . and N are opened, and then the supernatant brine is supplied by the filter pump 5 into the top filter unit A. Then, the supernatant brine is filtered by the filter layer 70 of the filter unit A and the filtered brine flows into the next filter unit B. Thus the brine flows through the filter units A, B, . . . and N successively and, finally, the filtered and purified brine is discharged through the purified brine discharge pipe 65 into the reservoir 7.

The level of the supernatant brine in the filter unit rises as the filter layer is clogged with the unsoluble matters. When the level of the supernatant brine in the filter unit rises above a predetermined level, the air vent valve is closed to raise the filtering pressure, and thereby the internal pressure of the filter unit rises gradually and a pressurized filtering mode is established automatically. When the filter layer is clogged further, the filtering pressure is thereby increased. Then, the discharge pressure of the filter pump 5 increases and the suspended unsoluble matters start permeating the filter layer. The suspended unsoluble matters permeating the filter layer of the preceding filter unit are arrested by the filter layer of the succeeding filter unit. When the filter layer of the last filter unit N is clogged with the unsoluble matters to a limit, the operation of the multistage filtering apparatus is interrupted and the multistage filtering apparatus is washed. The manner of washing the multistage filtering apparatus 6 will be described hereinafter.

A solvent containing hydrochloric acid is prepared in a solvent tank 16. Ordinarily, the solvent is a dilute hydrochloric acid solution, however, a salt solution acidified by hydrochloric acid or a solvent prepared by adjusting the acidity of the recycled solvent with hydrochloric acid may be used. The inlet valve $V_1$ and the outlet valve $V_2$ of the multistage filtering apparatus are closed and valves $V_3$ and $V_4$ are opened, and then the solvent contained in the solvent tank 16 is circulated through the multistage filtering apparatus 6 by means of the filter pump 5. The solvent may be circulated either along the same direction as that of the flow of the brine during the filtering operation or in the reverse direction. Most of the unsoluble matters arrested by the filter layers 70 is dissolved in and carried away by the solvent. Thus the filter layers are regenerated.

Then, the valve $V_4$ is closed to recover all the solvent from the multistage filtering apparatus 6 and the solvent is returned to the solvent tank 16. Then, a valve $V_7$ is opened to supply a washing liquid contained in a washing liquid tank 17 to the multistage filtering apparatus 6 by means of the filter pump 5. The residual solvent is washed out from the multistage filtering apparatus 6 into the solvent tank 16. During the washing operation, the valve $V_3$ and a valve $V_5$ are kept open so that the multistage filtering apparatus is washed as completely as possible. The most simple washing liquid is water, however, an alkaline solution, such as a caustic soda solution, a salt solution or the filtered and purified brine contained in the reservoir 7 may be used as the washing liquid.

After the acid solvent remaining in the multistage filtering apparatus 6 has completely been washed out and recovered in the solvent tank 16, the valves $V_3$ and $V_5$ are closed and a valve $V_6$ is opened to circulate the washing liquid by means of the filter pump 5 and to recover the washing liquid in the washing liquid tank 17. Upon the recognition of the complete regeneration of the filter layers 70, the valve $V_7$ is closed and after the residual washing liquid has been completely recovered, the valve $V_6$ is closed to complete the washing operation.

After the multistage filtering apparatus 6 has thus been washed, the valves $V_1$ and $V_2$ are opened to restart the filtration of the supernatant brine.

The solution containing the solution of the unsoluble matters arrested by the filter layers 70 and contained in the solvent tank 16 and the used and recovered washing liquid contained in the washing liquid tank 17 are supplied at a low flow rate to the saturated brine tank 1 by means of a pump 18 and are used for dissolving salt or are used for other purposes.

As apparent from the foregoing description, the present invention reduces the work and labor required for operating a brine purifying system remarkably and, since the unsoluble matters arrested by the multistage filtering apparatus, which require complicated measures to be disposed of, are disposed of as sludges from the thickner, the brine purifying system of the present invention simplifies the disposal of the waste matters remarkably.

Furthermore, since all the liquid used for regenerating the multistage filtering apparatus, which is used to be discharged from the system, is reused as the process water, the cost of the process water is reduced and waste water treatment is unnecessary.

Still further, since the multistage filtering apparatus can be regenerated in a short time, the operation rate of the multistage filtering apparatus is enhanced.

The combined effect of these advantages of the present invention reduces the operation cost of the system remarkably with a slight increase in the chemicals for washing the multistage filtering apparatus, and thereby the economic effect of the brine purifying system is improved significantly.

Although the invention has been described in its preferred form with a certain degree of particularity, it is to be understood that many changes and variations are possible in the invention without departing from the scope and spirit thereof.

What is claimed is:

1. A method for preparing purified brine comprising the steps of:

preparing saturated brine by dissolving salt in at least one of a dilute brine recovered from a brine electrolyzer and pure water;

mixing alkaline solution containing at least one of caustic soda and sodium carbonate with the saturated brine to percipitate unsoluble matters;

separating the precipitated unsoluble matters from the saturated brine by depositing the precipitated unsoluble matters in a tank to obtain supernatant brine;

filtering the supernatant brine by a filtering apparatus to remove residual unsoluble matters remaining in the supernatant brine to obtain purified brine;

adjusting the pH of the purified brine with hydrochloric acid to produce high-purity brine for electrolyzation of salt;

interrupting the operation of the filtering apparatus when the filtering apparatus is clogged;

supplying an acidic solvent containing hydrochloric acid to the filtering apparatus for regenerating the filtering apparatus by dissolving the unsoluble matters trapped by the filtering apparatus;

cleaning the filtering apparatus by suppyling a washing liquid selected from purified brine, pure water, alkaline solution and salt solution through the filtering apparatus;

recovering all or part of both the acidic solvent and washing liquid used for regeneration of the filtering apparatus; and, utilizing the recovered acidic solvent and washing liquid in preparing the saturated brine.

2. The method according to claim 1, wherein said filtering apparatus comprises a plurality of filter units positioned one over another to form cascading filtering stages.

* * * * *